United States Patent [19]

Marks et al.

[11] Patent Number: 5,000,711

[45] Date of Patent: Mar. 19, 1991

[54] METHOD OF MAKING COLOR PICTURE TUBE SHADOW MASK HAVING IMPROVED TIE BAR LOCATIONS

[75] Inventors: Bruce G. Marks, Lancaster; Andrew Good, Reamstown, both of Pa.

[73] Assignee: RCA Licensing Corporation, Princeton, N.J.

[21] Appl. No.: 547,004

[22] Filed: Jul. 2, 1990

[51] Int. Cl.[5] ..... H01J 9/00

[52] U.S. Cl. ..... 445/47

[58] Field of Search ..... 445/47

[56] References Cited

U.S. PATENT DOCUMENTS

| | | | |
|---|---|---|---|
| 3,766,419 | 10/1973 | Barbin | 313/92 B |
| 3,973,159 | 8/1976 | Barten | 313/403 |
| 4,210,842 | 7/1980 | Nakayama et al. | 313/403 |
| 4,293,791 | 10/1981 | D'Amato | 313/403 |
| 4,306,172 | 12/1981 | Matsukura et al. | 445/47 X |
| 4,326,147 | 4/1982 | Nakayama et al. | 313/403 |
| 4,443,499 | 4/1984 | Lipp | 445/47 X |
| 4,482,334 | 11/1984 | Ohtake et al. | 445/47 |
| 4,716,333 | 12/1987 | Kiyoshi et al. | 445/47 X |

FOREIGN PATENT DOCUMENTS 0321202 6/1989 European Pat. Off. .

*Primary Examiner*—Kenneth J. Ramsey

*Attorney, Agent, or Firm*—Joseph S. Tripoli; Dennis H. Irlbeck

[57] ABSTRACT

An improved method of making a color picture tube shadow mask includes first constructing an apertured flat mask which is formed into a domed contoured mask. The mask has a rectangular periphery with two long sides and two short sides. The mask has a major axis, which passes through the center of the mask and parallels the long sides, and a minor axis, which passes through the center of the mask and parallels said short sides. The mask includes slit-shaped apertures aligned in columns that essentially parallel the minor axis. Adjacent apertures in each column are separated by tie bars in the mask, with the spacing between tie bars in a column being the tie bar pitch at a particular location on the mask. The improvement comprises a first step of calculating the desired tie bar shadow locations at several discrete areas, for a given scan line pitch, as viewed from a distance in front of a viewing screen of a tube. The desired tie bar shadow locations are those locations that will give an optimized compromise for moiré at each of the discrete areas. Next, the corresponding tie bar shadow locations on the screen are determined, taking into account the angles of the screen slope at the discrete areas. The corresponding tie bar pitches are then determined on a formed contoured shadow mask, taking into account the mask to screen spacing at each of the discrete areas. Then, the tie bar pitches on the unformed flat mask are calculated, by subtracting the stretch caused by the mask formign step. The stretch is determined by actual measurements of vertical pitch at the discrete areas on the apertured formed mask and by comparing these measurements with measurements made on the flat mask prior to forming. Finally, a least squares fitting is performed on the calculated flat mask tie bar pitches, to obtain the locations of tie bars at all areas on the flat mask.

1 Claim, 5 Drawing Sheets

METHOD OF MAKING COLOR PICTURE TUBE SHADOW MASK HAVING IMPROVED TIE BAR LOCATIONS

This invention relates to color picture tubes of a type having shadow masks with slit-shaped apertures, wherein the apertures are aligned in columns and the apertures in each column are separated by tie bars in the mask, and particularly to a method of making such a mask with a tie bar arrangement which permits optimum moiré performance over the entire screen of a color picture tube.

BACKGROUND OF THE INVENTION

A predominant number of color picture tubes in use today have line screens and shadow masks that include slit-shaped apertures. The apertures are aligned in columns, and the adjacent apertures in each column are separated from each other by webs or tie bars in the mask. Such tie bars are essential in a the mask, to maintain its integrity when it is formed into a dome-shaped contour which somewhat parallels the contour of the interior of a viewing faceplate of a tube. Tie bars in one column are offset in the longitudinal direction of the column (vertical direction) from the tie bars in the immediately adjacent columns. When electron beams strike the shadow mask, the tie bars block portions of the beams, thus causing shadows on the screen immediately behind the tie bars.

When the electron beams are repeatedly scanned in a direction perpendicular to the aperture columns (horizontal direction), they create a series of bright and dark horizontal lines on the screen. These bright-and dark horizontal lines interact with the shadows formed by the tie bars, creating lighter and darker areas and producing a wavy pattern on the screen, called a moiré pattern. Such moiré pattern greatly impairs the visible quality of image displayed on the screen. It is highly desirable to select a moiré mode that will minimize the moiré pattern for any scan condition used in a television receiver. The two scan conditions presently in use are interlaced scan and noninterlaced scan. A moiré mode is the ratio of scan line pitch to tie bar shadow pitch. Because of the practical limitations of light output and mask strength, the moiré mode is usually chosen to be between 6/8 and 10/8. In the following embodiments incorporating the present invention, a value for moiré mode is chosen to minimize the moiré patterns caused by both interlaced and noninterlaced scan. Both of these scans have maximums and minimums at exactly inverse points. Therefore, a compromise value for moiré mode is selected which will provide a low amount of moiré for either scan. This compromise value is approximately 6.5/8.

There is a possibility for use of a third scan condition. This third condition is called progressive scan and may be used on high definition television receivers. A higher scan frequency is necessary for progressive scan. In the special case of progressive scan, only one scan condition is considered to minimize the moiré pattern. This produces less moiré and a much smoother picture. For this condition, a moir,é mode value of lower than 6/8 or higher than 10/8 would be used.

There have been many techniques suggested to reduce the moiré problem. Most of these techniques involve rearranging the locations of the tie bars in a mask to reduce the possibility of the electron beam scan lines beating with the tie bar shadows. Although many of these techniques have been used successfully in the past to reduce moiré, most of the prior techniques do not correct the moiré problem in all parts of a screen, so that there is still a need for improved moiré reduction techniques. Such improved techniques are especially needed for the newer higher quality color picture tubes that are required for higher definition television. For example, as the quality of electron guns improves to meet the needs of higher definition television, such improved guns produce smaller electron beam spots at the screen. This reduction in electron beam spot size produces visually sharper scan lines on the screen which interact with the tie bar shadows and increase the moiré pattern problem.

SUMMARY OF THE INVENTION

An improved method of making a color picture tube shadow mask includes first constructing an apertured flat mask which is formed into a domed contoured mask. The mask has a rectangular periphery with two long sides and two short sides. The mask has a major axis, which passes through the center of the mask and parallels the long sides, and a minor axis, which passes through the center of the mask and parallels said short sides. The mask includes slit-shaped apertures aligned in columns that essentially parallel the minor axis. Adjacent apertures in each column are separated by tie bars in the mask, with the spacing between tie bars in a column being the tie bar pitch at a particular location on the mask. The improvement comprises a first step of calculating the desired tie bar shadow locations at several discrete areas, for a given scan line pitch, as viewed from a distance in front of a viewing screen of a tube. The desired tie bar shadow locations are those locations that will give an optimized compromise for moiré at each of the discrete areas. Next, the corresponding tie bar shadow locations on the screen are determined, taking into account the angles of the screen slope at the discrete areas. The corresponding tie bar pitches are then determined on a formed contoured shadow mask, taking into account the mask to screen spacing at each of the discrete areas. Then, the tie bar pitches on the unformed flat mask are calculated, by subtracting the stretch caused by the mask forming step. The stretch is determined by actual measurements of vertical pitch at the discrete areas on the apertured formed mask and by comparing these measurements with measurements made on the flat mask prior to forming. Finally, a least squares fitting is performed on the calculated flat mask tie bar pitches, to obtain the locations of tie bars at all areas on the flat mask.

DETAILED DESCRIPTION OF THE PREFERRED EMBODIMENTS

Figure 1:
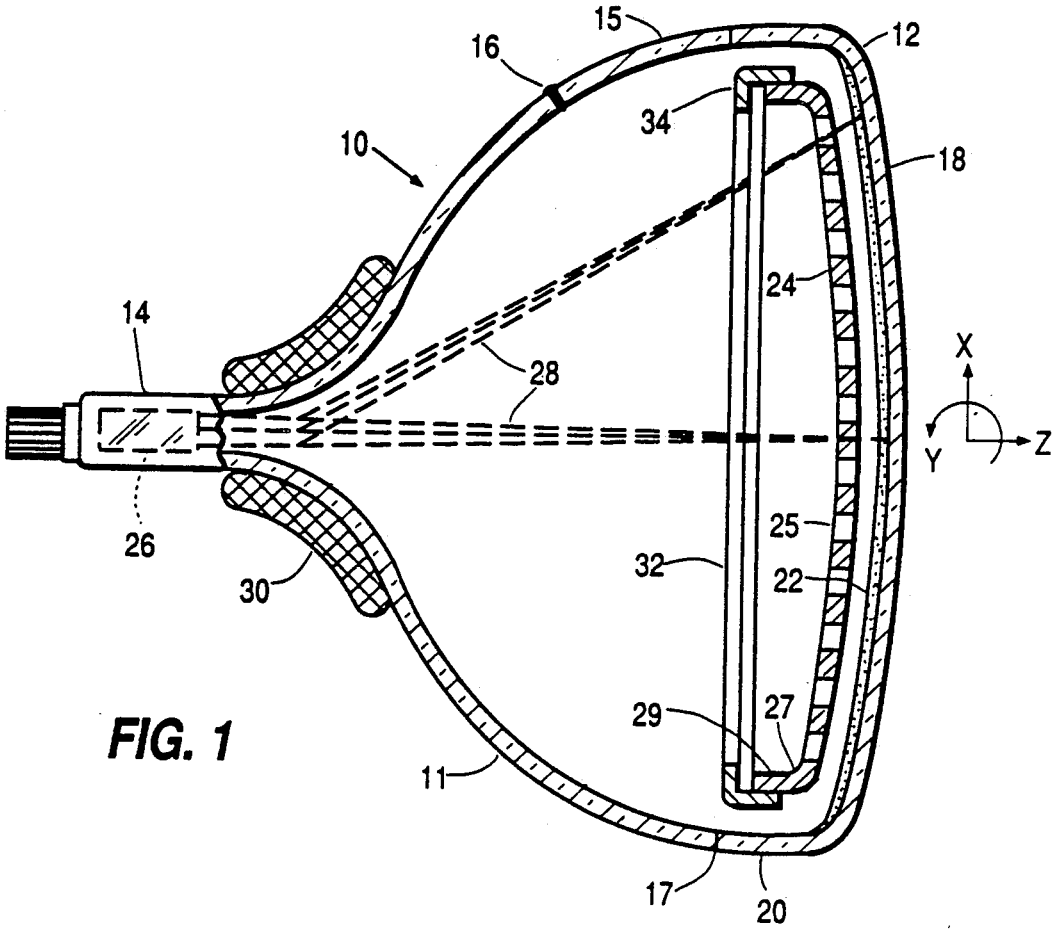
FIG. 1 is an axially sectioned side view of a color picture tube embodying the present invention.

FIG. 1 shows a rectangular color picture tube 10 having a glass envelope 11 comprising a rectangular faceplate panel 12 and a tubular neck 14 connected by a rectangular funnel 15. The funnel 15 has an internal conductive coating (not shown) that extends from an anode button 16 to the neck 14. The panel 12 comprises a viewing faceplate 18 and a peripheral flange or sidewall 20, which is sealed to the funnel 15 by a glass frit 17. A three-color phosphor screen 22 is carried by the inner surface of the faceplate 18. The screen 22 is a line screen with the phosphor lines arranged in triads, each triad including a phosphor line of each of the three colors. A multi-apertured color selection electrode or shadow mask 24 is removably mounted, by conventional means, in predetermined spaced relation to the screen 22. An electron gun 26, shown schematically by dashed lines in FIG. 1, is centrally mounted within the neck 14 to generate and direct three electron beams 28 along convergent paths through the mask 24 to the screen 22.

The tube of FIG. 1 is designed to be used with an external magnetic deflection yoke, such as the yoke 30 shown in the neighborhood of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is at about the middle of the yoke 30. Because of fringe fields, the zone of deflection of the tube extends axially from the yoke 30 into the region of the gun 26. For simplicity, the actual curvatures of the deflected beam paths in the deflection zone are not shown in FIG. 1.

The shadow mask 24 is part of a mask-frame assembly 32 that also includes a peripheral frame 34. The mask-frame assembly 32 is shown positioned within the faceplate panel 12 in FIG. 1. The shadow mask 24 includes a curved apertured portion 25, an imperforate border portion 27 surrounding the apertured portion 25, and a skirt portion 29 bent back from the border portion 27 and extending away from the screen 22. The mask 24 is telescoped within or over the frame 34 and the skirt portion 29 is welded to the frame 34.

Figure 2:
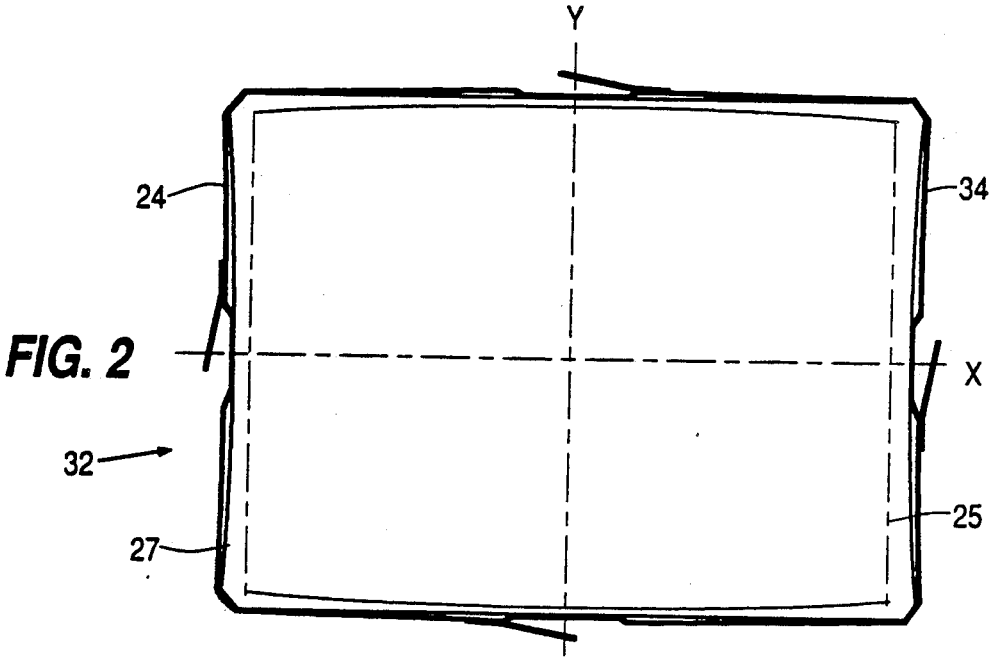
FIG. 2 is rear plan view of a faceplate panel of the tube of FIG. 1.
Figure 3:
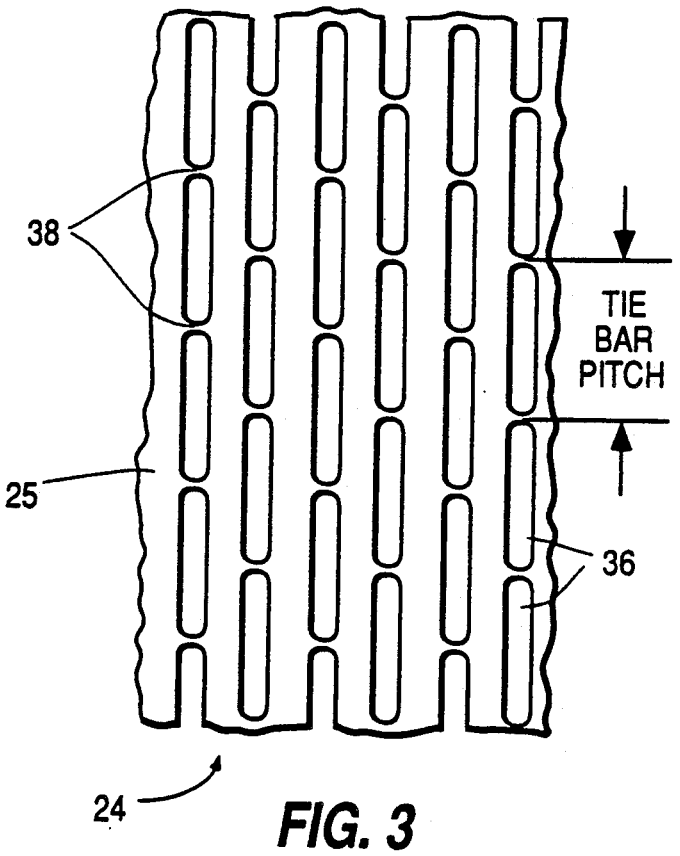
FIG. 3 is an enlarged view of a small portion of a shadow mask of the tube of FIG. 1.

The shadow mask 24, shown in greater detail in FIGS. 2 and 3, has a rectangular periphery with two long sides and two short sides. The mask 24 has a major axis X which passes through the center of the mask and parallels the long sides and a minor axis Y which passes through the center of the mask and parallels the short sides. The mask 24 includes slit-shaped apertures 36 aligned in columns that essentially parallel the minor axis Y. Adjacent apertures 36 in each column are separated by tie bars 38 in the mask, with the spacing between tie bars 38 in a column being defined as the tie bar pitch at a particular location on the mask, as shown in FIG. 3.

The method of making the shadow mask 24 includes constructing an apertured flat mask which is later formed into a domed contoured mask. In order to minimize moiré in a tube, the moiré mode of 6.5/8 is selected. Unlike prior tubes, the method of the present invention permits variation of tie bar pitch over the mask to maintain the 6.5/8 moiré mode over the entire tube screen.

Figure 4:
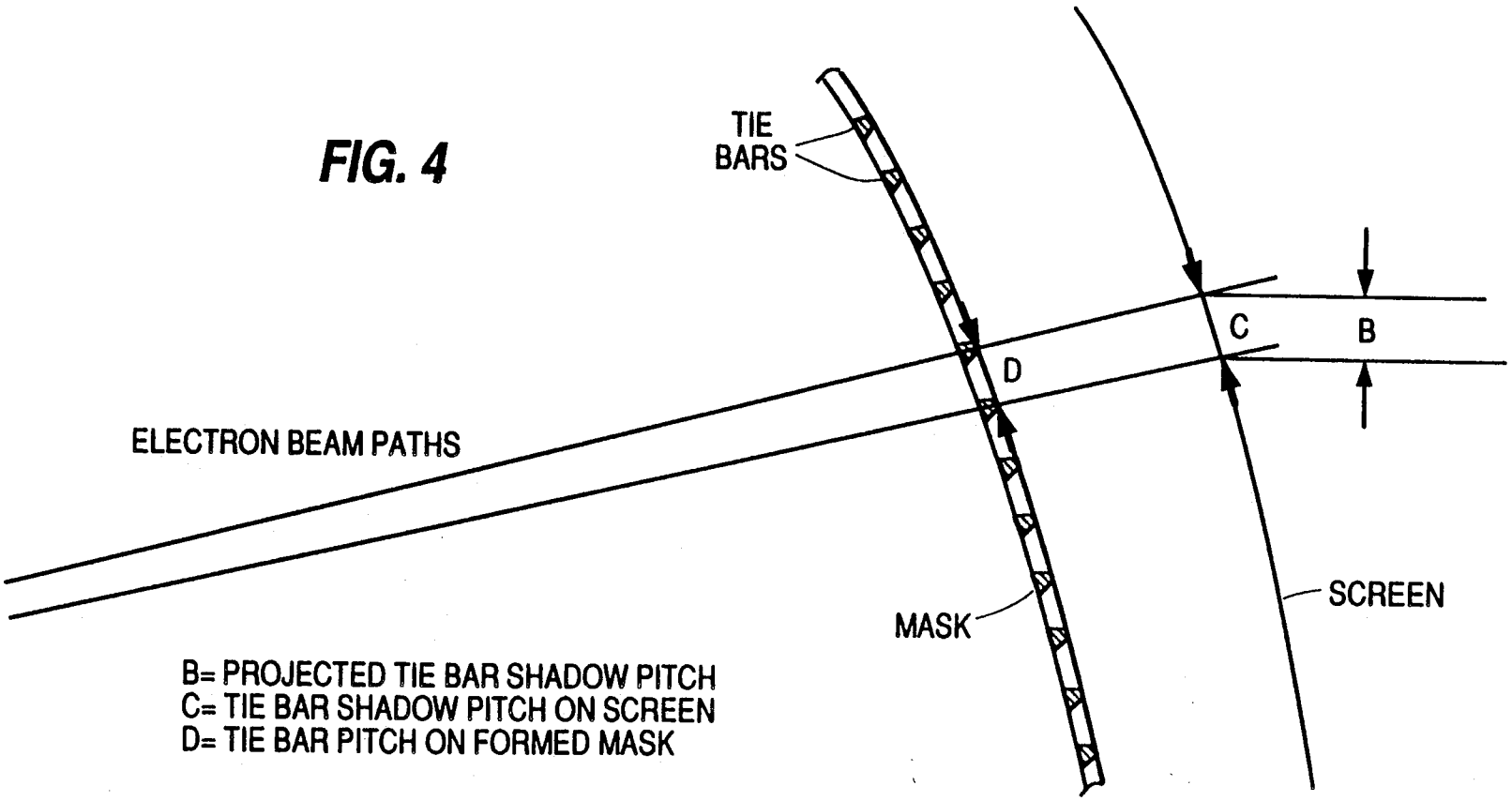
FIG. 4 is a schematic side view of a faceplate, shadow mask and electron beam.
Figure 5:
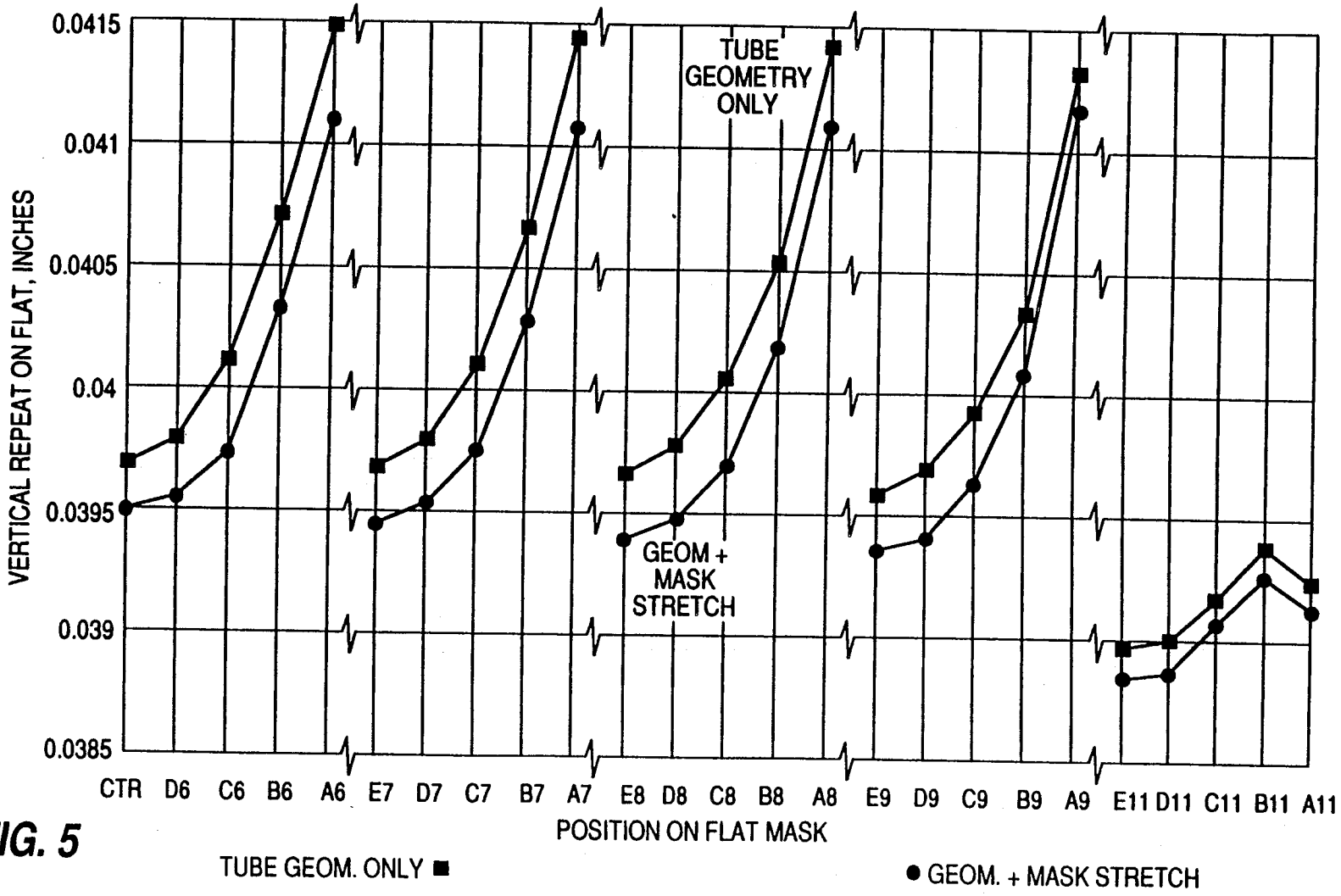
FIG. 5 is a graph showing vertical tie bar pitch versus positions on a mask, for two conditions.

The method of the present invention includes a calculation of the desired tie bar pitch for a flat mask, which takes into account many factors. First, for a given scan line pitch, the desired tie bar shadow locations are calculated at several discrete areas, as viewed from a distance in front of the viewing screen, as shown in FIG. 4. Such desired tie bar shadow locations are those locations that will give an optimized compromise for moiré at each of the discrete areas. Next, the corresponding tie bar shadows on the screen are determined, taking into account the angles of the screen slope at the discrete areas. Thereafter, the corresponding tie bar pitches are determined on the formed contoured shadow mask, taking into account the mask to screen spacing at each of the discrete areas. Then, the tie bar pitches on the unformed flat mask are calculated by subtracting the stretch caused by the mask forming step. Such stretch is determined by actual measurements of vertical pitch at the discrete areas on the apertured formed mask and by comparing these measurements with measurements made on the flat mask prior to forming. This determination may include several iterative steps. Once the stretch measurements are obtained, the results are smoothed by a least squares fitting. Finally, a least squares fitting is made on the flat mask tie bars. An evaluation of this fitting gives flat mask tie bar locations for any X,Y location.

Figure 6:
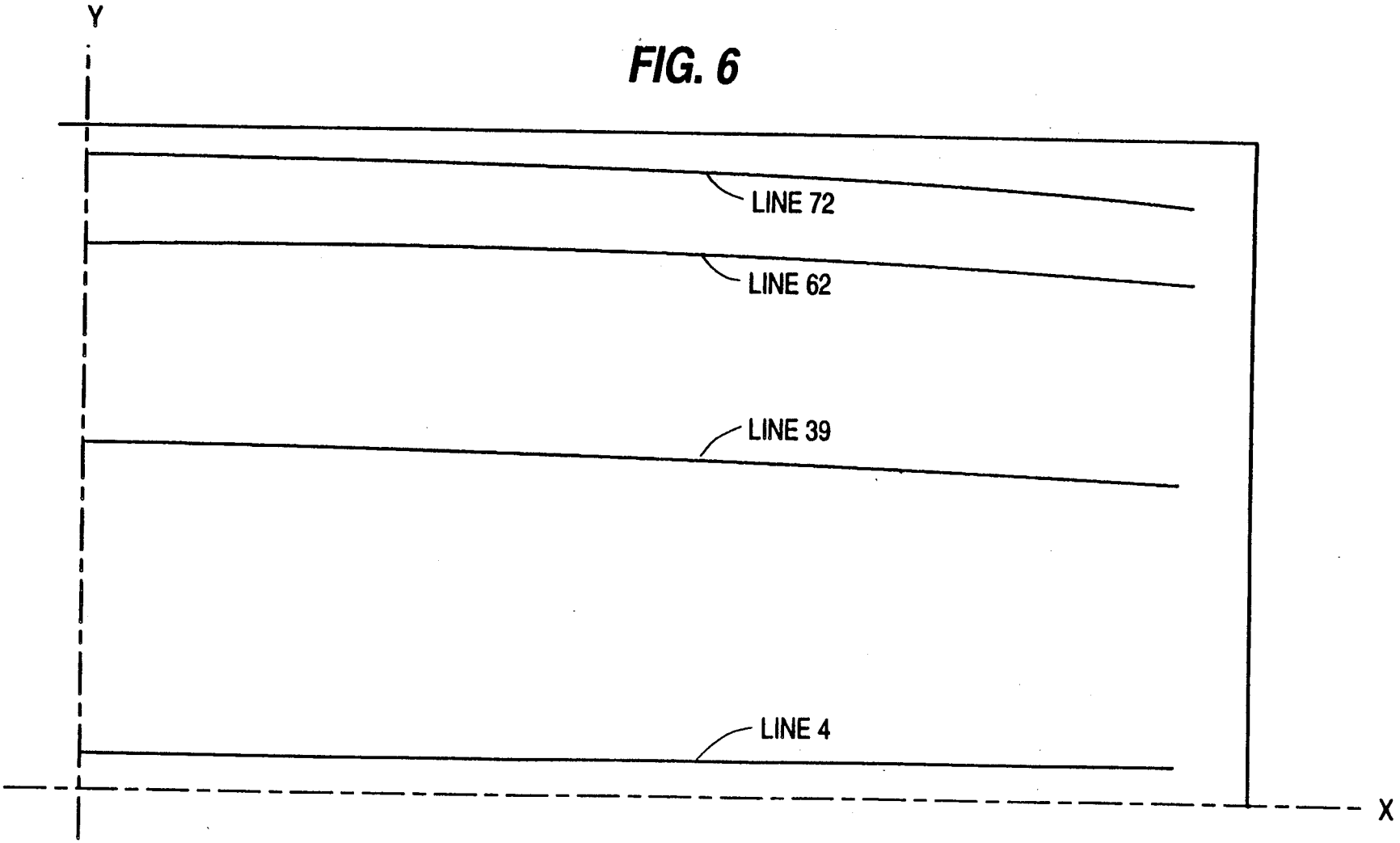
FIG. 6 is a quadrant of a flat mask showing tie bar lines at selected locations.

The tie bars lie in slightly curved rows on the flat mask, as shown by the lines 40 in FIG. 6. When the flat mask is formed into a contoured mask, these tie bar rows will essentially parallel the electron beam scan lines. The minor axis Y intercept of any line is determined by the following equation.

$$Y_0 = \Sigma_i A(i) \cdot 10^P [\text{line no.}/20]^{(i-1)},$$

where $Y_0$ is the distance along the minor axis Y from the major axis X, A(i) is a coefficient which varies with tube type, P represents a power of 10, line no. is the number of any tie bar line counted from the major axis X, and i is a number from 1 to 8. The following table lists the coefficients A(i), in millimeters, and powers P for a tube having a viewing screen with a 4/3 aspect ratio and a diagonal of 27 inches (69 cm).

| i | A(i) | P |
|---|---|---|
| 1 | +0.148521147 | −02 |
| 2 | +0.201883708 | +02 |
| 3 | +0.515882181 | −02 |
| 4 | −0.961782232 | −04 |
| 5 | +0.942476286 | −03 |
| 6 | −0.196143641 | −03 |
| 7 | +0.217857704 | −04 |
| 8 | −0.883130324 | −06 |

The vertical distance Y from any tie bar row to the major axis X, at any point off of the minor axis, is determined by the following equation.

$$Y = Y_0 + Y_D,$$

where:

$$Y_D = \Sigma_n C(n) \cdot 10^P (Y_0)^j (X)^k$$

where n is a number from 1 to 72, C(n) is a coefficient which varies with tube type, P represents a power of 10, X is distance along the major axis, j and k are powers of $Y_0$ and X, respectively, and wherein j and k vary from 0 to 8.

The following table lists the coefficients C(n) in millimeters and powers P, the j powers of $Y_0$ and the k powers of X for a tube having a 4/3 aspect ratio and a viewing screen diagonal of 27 inches (69 cm).

| n | C(n) | P | j | k |
|---|---|---|---|---|
| 1 | −0.171632565 | −03 | 0 | 0 |
| 2 | −0.610997633 | −06 | 1 | 0 |
| 3 | +0.702546929 | −06 | 2 | 0 |
| 4 | −0.197181946 | −07 | 3 | 0 |
| 5 | +0.202340572 | −09 | 4 | 0 |
| 6 | −0.814230858 | −12 | 5 | 0 |
| 7 | +0.535644093 | −15 | 6 | 0 |
| 8 | +0.255669057 | −17 | 7 | 0 |
| 9 | +0.521881441 | −04 | 0 | 1 |
| 10 | +0.178446725 | −04 | 1 | 1 |
| 11 | −0.116330556 | −05 | 2 | 1 |
| 12 | +0.241911266 | −07 | 3 | 1 |
| 13 | −0.221083296 | −09 | 4 | 1 |
| 14 | +0.908496783 | −12 | 5 | 1 |
| 15 | −0.123514510 | −14 | 6 | 1 |
| 16 | −0.673379612 | −18 | 7 | 1 |
| 17 | −0.377775931 | −06 | 0 | 2 |
| 18 | −0.197025617 | −06 | 1 | 2 |
| 19 | −0.128682435 | −09 | 2 | 2 |
| 20 | −0.476160554 | −10 | 3 | 2 |
| 21 | +0.189796988 | −11 | 4 | 2 |
| 22 | −0.260918785 | −13 | 5 | 2 |
| 23 | +0.143037389 | −15 | 6 | 2 |
| 24 | −0.271610639 | −18 | 7 | 2 |
| 25 | −0.556454259 | −07 | 0 | 3 |
| 26 | −0.258010721 | −07 | 1 | 3 |
| 27 | −0.258010721 | −08 | 2 | 3 |
| 28 | −0.339182749 | −10 | 3 | 3 |
| 29 | +0.318019422 | −12 | 4 | 3 |
| 30 | −0.140390665 | −14 | 5 | 3 |
| 31 | +0.247204482 | −17 | 6 | 3 |
| 32 | −0.492420553 | −21 | 7 | 3 |
| 33 | +0.146150709 | −08 | 0 | 4 |
| 34 | +0.484864375 | −09 | 1 | 4 |
| 35 | −0.299146168 | −10 | 2 | 4 |
| 36 | +0.577885755 | −12 | 3 | 4 |
| 37 | −0.462658081 | −14 | 4 | 4 |
| 38 | +0.136059942 | −16 | 5 | 4 |
| 39 | +0.849637875 | −20 | 6 | 4 |
| 40 | −0.798143670 | −22 | 7 | 4 |
| 41 | −0.149841269 | −10 | 0 | 5 |
| 42 | −0.374286373 | −11 | 1 | 5 |
| 43 | +0.220866619 | −12 | 2 | 5 |
| 44 | −0.363835255 | −14 | 3 | 5 |
| 45 | +0.165549704 | −16 | 4 | 5 |
| 46 | +0.870527585 | −19 | 5 | 5 |
| 47 | −0.944678806 | −21 | 6 | 5 |
| 48 | +0.212447968 | −23 | 7 | 5 |
| 49 | +0.755337670 | −13 | 0 | 6 |
| 50 | +0.145763332 | −13 | 1 | 6 |
| 51 | −0.799625583 | −15 | 2 | 6 |
| 52 | +0.971111924 | −17 | 3 | 6 |
| 53 | +0.359421605 | −19 | 4 | 6 |
| 54 | −0.133055070 | −20 | 5 | 6 |
| 55 | +0.818810441 | −23 | 6 | 6 |

-continued

| n | C(n) | P | j | k |
|---|---|---|---|---|
| 56 | −0.160006552 | −25 | 7 | 6 |
| 57 | −0.187071051 | −15 | 0 | 7 |
| 58 | −0.292774275 | −16 | 1 | 7 |
| 59 | +0.140517819 | −17 | 2 | 7 |
| 60 | −0.806161474 | −20 | 3 | 7 |
| 61 | −0.307557583 | −21 | 4 | 7 |
| 62 | +0.488050766 | −23 | 5 | 7 |
| 63 | −0.261692250 | −25 | 6 | 7 |
| 64 | +0.484705788 | −28 | 7 | 7 |
| 65 | +0.182208410 | −18 | 0 | 8 |
| 66 | +0.247372629 | −19 | 1 | 8 |
| 67 | −0.954593827 | −21 | 2 | 8 |
| 68 | −0.360214960 | −23 | 3 | 8 |
| 69 | +0.448682479 | −24 | 4 | 8 |
| 70 | −0.574337334 | −26 | 5 | 8 |
| 71 | +0.287865932 | −28 | 6 | 8 |
| 72 | −0.516653672 | −31 | 7 | 8 |

What is claimed is:

1. In a method of making a shadow mask for a color picture tube, said method including constructing an apertured flat mask which is formed into a domed contoured mask, said mask having a rectangular periphery with two long sides and two short sides, with a major axis passing through the center of said mask and paralleling said long sides and a minor axis passing through the center of said mask and paralleling said short sides, and said mask including slit-shaped apertures aligned in columns that essentially parallel said minor axis, adjacent apertures in each column being separated by tie bars in said mask, and the spacing between tie bars in a column being the tie bar pitch at a location on the mask, the improvement comprising (a) calculating the desired tie bar shadow locations at several discrete areas, for a given scan line pitch, as viewed from a distance in front of a viewing screen of a tube, said desired tie bar shadow locations being those that will give an optimized compromise for moiré at each of said discrete areas, (b) determining the corresponding tie bar shadow locations on the screen, taking into account the angles of the screen slope at said discrete areas, (c) determining the corresponding tie bar pitches on a formed contoured shadow mask, taking into account the mask to screen spacing at each of said discrete areas, (d) calculating the tie bar pitches on the unformed flat mask, by subtracting the stretch caused by the mask forming step, said stretch being determined by actual measurements of vertical pitch at discrete areas on an apertured formed mask and by comparing those measurements with measurements made on the flat mask prior to forming, and (e) performing a least squares fitting on the calculated flat mask tie bar pitches, to obtain the locations of tie bars at all areas on the flat mask.

* * * * *